US008795445B2

(12) United States Patent
Shirai et al.

(10) Patent No.: US 8,795,445 B2
(45) Date of Patent: Aug. 5, 2014

(54) TITANIUM PLATE AND METHOD OF PRODUCING THE SAME

(75) Inventors: Yoshihisa Shirai, Osaka (JP); Satoshi Matsumoto, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 67 days.

(21) Appl. No.: 12/934,284

(22) PCT Filed: Dec. 17, 2008

(86) PCT No.: PCT/JP2008/072975

§ 371 (c)(1),
(2), (4) Date: Sep. 24, 2010

(87) PCT Pub. No.: WO2009/118964

PCT Pub. Date: Oct. 1, 2009

(65) Prior Publication Data

US 2011/0017369 A1 Jan. 27, 2011

(30) Foreign Application Priority Data

Mar. 25, 2008 (JP) ..... 2008-077673

(51) Int. Cl.
*C22C 14/00* (2006.01)
*C22F 1/18* (2006.01)

(52) U.S. Cl.
USPC ..... 148/421; 148/670; 420/417

(58) Field of Classification Search
USPC ..... 148/421, 670; 420/417
See application file for complete search history.

(56) References Cited

U.S. PATENT DOCUMENTS 4,871,400 A * 10/1989 Shindo et al. ..... 148/671

FOREIGN PATENT DOCUMENTS

| | | |
|---|---|---|
| JP | 59-179772 | 10/1984 |
| JP | 62-087932 | 4/1987 |
| JP | 63-060247 | 3/1988 |
| JP | 63-186843 | 8/1988 |
| JP | 63-270449 | 11/1988 |
| JP | 07-062466 | 3/1995 |
| JP | 09-003573 | 1/1997 |
| JP | 2006-316323 | 11/2006 |

OTHER PUBLICATIONS

Gilbert et al., ASM Handbook, Heat Treating of Titanium and Titanium Alloys-Annealing, 1991, ASM International, vol. 4, (pp. 913-923), pp. 1-3 of 3.*
Takeshi Kudo et al. "Ti-Fe Kei . . . no Eikyo"("Influence of . . . titanium alloys-2" vol. 21, No. 1, Mar. 1, 2008, p. 698.

* cited by examiner

*Primary Examiner* — Roy King
*Assistant Examiner* — Caitlin Kiechle
(74) *Attorney, Agent, or Firm* — Clark & Brody

(57) ABSTRACT

There is provided a titanium plate having both high strength and good workability. The titanium plate is made of a titanium material in a plate shape, the titanium material consisting of by mass: more than 0.10% and less than 0.60% iron; more than 0.005% and less than 0.20% oxygen; less than 0.015% carbon; less than 0.015% nitrogen; less than 0.015% hydrogen; and balance titanium and unavoidable impurities, provided that the iron content is greater than the oxygen content, wherein the titanium plate has a two-phase structure of an α phase and a β phase and the circle-equivalent mean diameter of α phase grains is 10 μm or less.

3 Claims, 1 Drawing Sheet

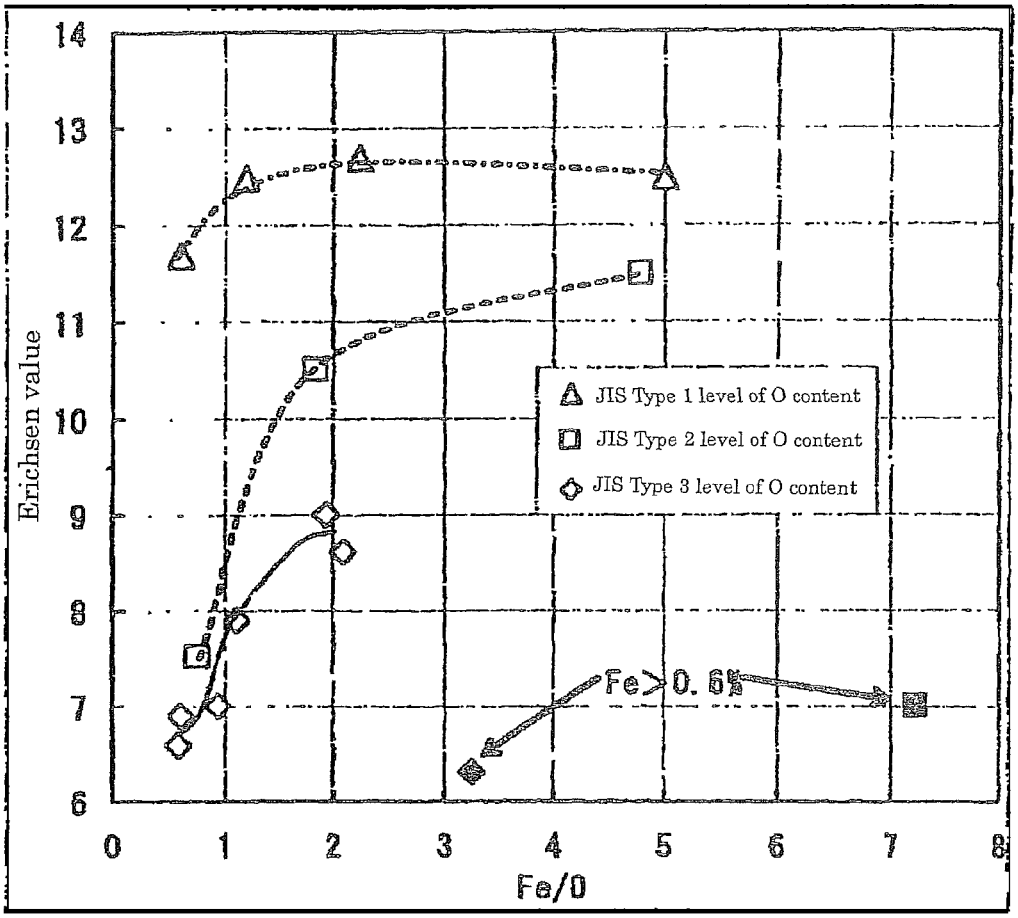
14
13
12
11
10
9
8
7
6
Erichsen value
0
1
2
3
4
5
6
7
8
Fe/O
JIS Type 1 level of O content
JIS Type 2 level of O content
JIS Type 3 level of O content
Fe>0.6%

TITANIUM PLATE AND METHOD OF PRODUCING THE SAME

FIELD OF THE INVENTION

The present invention relates to a titanium plate and a method of producing the same, and more specifically to a titanium plate having good formability and a method of producing the same.

BACKGROUND OF THE INVENTION

Hitherto, titanium materials such as titanium alloys and pure titanium have been widely used in sporting and recreational goods, medical instruments, various plant components, aerospace instruments and the like because they are typically light and strong compared to iron metal materials such as iron and iron alloys.

Also, because of their high corrosion resistance, titanium materials have been used, for example, in plates in a plate heat exchanger, in a muffler of a motorcycle and the like.

In the production of such products, for example, plates made of a titanium material (titanium plates) are subjected to various processes such as bending and drawing which involve plastic deformation.

In view of the use in such a variety of applications, there has been a need for titanium plates that exhibit good workability in forming processes such as drawing.

What is called "commercially pure titanium" is classified, for example, into JIS Type 1, JIS Type 2, JIS Type 3 and JIS Type 4. In terms of material characteristics, it is known that Type 1 has the lowest strength, and the greater the type number, the higher the strength.

Meanwhile, formability decreases as the type number increases, and performing a process such as drawing using larger type number titanium would be difficult.

To address this issue, Patent Documents 1 and 2 describe that formability can be improved by regulating the contents of components other than titanium in "commercially pure titanium" within a predetermined range. It is difficult, however, to expect sufficiently high strength in titanium products described in these documents.

Patent Document 3 describes that products made of a titanium alloy with a predetermined Fe content exhibit good polishability, while Patent Documents 4 and 5 describe that products made of a titanium alloy with a predetermined content of Zr or the like have good polishability.

Articles made of such a titanium alloy as described in Patent Documents 3 to 5 are believed to exhibit good polishability and high strength because of the fine crystal grains and high hardness they have.

However, when titanium plates are made of such titanium alloys as described in Patent Documents 3 to 5, they are not expected to have good workability because processes such as drawing cannot be easily performed, for example.

The problem therefore is that it has conventionally been difficult to produce a titanium plate having both high strength and good workability.

Patent Document 1: Japanese Patent Application Laid-open No. Sho-63-60247

Patent Document 2: Japanese Patent Application Laid-open No. Hei-9-3573

Patent Document 3: Japanese Patent Application Laid-open No. Hei-7-62466

Patent Document 4: Japanese Patent Application Laid-open No. Sho-62-87932

Patent Document 5: Japanese Patent Application Laid-open No. Sho-63-186843

DISCLOSURE OF THE INVENTION

Problems to be Solved by the Invention

It is an object of the present invention to provide a titanium plate having both high strength and good workability.

Means to Solve the Problems

The present inventors have intensively studied the components of a titanium plate and the like and found that a titanium plate having high strength and good workability can be produced by adjusting the contents of iron and oxygen to given amounts, and thus achieved the present invention.

Specifically, in order to solve the above problems, the present invention provides a titanium plate made of a titanium material in a plate shape, the titanium material consisting of by mass: more than 0.10% and less than 0.60% iron; more than 0.005% and less than 0.20% oxygen; less than 0.015% carbon; less than 0.015% nitrogen; less than 0.015% hydrogen; and balance titanium and unavoidable impurities, provided that the iron content is greater than the oxygen content, wherein the titanium plate has a two-phase structure of an $\alpha$ phase and a $\beta$ phase, and wherein the circle-equivalent mean diameter of $\alpha$ phase grains is 10 μm or less.

Furthermore, in order to solve the above problems, the present invention provides a method of producing a titanium plate using a titanium material that consists of by mass: more than 0.10% and less than 0.60% iron; more than 0.005% and less than 0.20% oxygen; less than 0.015% carbon; less than 0.015% nitrogen; less than 0.015% hydrogen; and balance titanium and unavoidable impurities, provided that the iron content is greater than the oxygen content, the method comprising, processing the titanium material under the conditions of: a finish cold rolling reduction ratio of 20% or more; a finish annealing temperature of 600 to 880° C.; a finish annealing time of 0.5 to 60 minutes; and the value of G in the following formula (1) being 14 or less:

$$G=11.5\times X_{Fe}^{-0.72}\times\{-1n(1-r/100)\}^{-0.35}\times\exp\{(-1500)/(273+T)\}\times t^{0.058} \quad (1)$$

where $X_{Fe}$ represents the Fe content (%), r represents the finish cold rolling reduction ratio (%), T represents the annealing temperature (° C.) and t represents the finish annealing time (min).

Advantages of the Invention

According to the present invention, it is possible to provide a titanium plate having high strength as well as good workability.

BRIEF DESCRIPTION OF THE DRAWING

FIG. 1 is a graph in which the horizontal axis represents the values of the Fe/O ratios (Fe content/O content) in Table 1 and the vertical axis represents the Erichsen values in the same.

BEST MODE FOR CARRYING OUT THE INVENTION

Preferred embodiments of the present invention are described below, beginning with a titanium plate according to this embodiment.

A titanium plate according to this embodiment is made of a titanium material in a plate shape, the titanium material containing by mass: more than 0.10% and less than 0.60% iron (Fe); more than 0.005% and less than 0.20% oxygen (O); less than 0.015% carbon (C); less than 0.015% nitrogen (N); less than 0.015% hydrogen (H); and balance titanium (Ti) and unavoidable impurities, provided that the Fe content is greater than the O content, wherein the titanium plate has a two-phase structure of an α phase and a β phase, and wherein the circle-equivalent mean diameter of α phase grains is 10 μm or less.

As described above, the iron (Fe) is contained in the titanium material in the amount of more than 0.10% and less than 0.60% by mass.

In a titanium material, Fe is a β stabilizer element and though it partly forms a solid solution, it mostly allows a β phase to form, and after being subjected to heat treatment or the like, Fe is present in the form of TiFe. Such characteristics of Fe are known to suppress the growth of crystal grains in a titanium material. Because of this, it has conventionally been believed that an increase of the Fe content in a titanium material causes the size of crystal grains in a titanium plate to be reduced, which can enhance the strength of the titanium material and improve the polishing workability but results in lowering of the indices indicating ductility (forming workability) such as the Erichsen value.

However, as described below, by increasing the Fe content in a titanium material while adjusting the O content in the titanium material to a predetermined amount, it is possible to enhance the strength of the resulting titanium plates while at the same time preventing a decrease in the ductility thereof.

Thus, Fe is contained in the titanium material in the amount of more than 0.10% and less than 0.60% by mass because if the Fe content is 0.1% or less, the produced titanium plates will not have sufficient strength and thus have reduced polishing workability.

In the meantime, if the Fe content is 0.06% or more, a decrease in ductility occurs even if the O content in the titanium material is adjusted to a predetermined value. This results in a decrease in the formability of a titanium plate.

In this regard, the Fe content is preferably limited to 0.40% or less.

The oxygen (O), as described above, is contained in the titanium material in the amount of more than 0.005% and less than 0.20% by mass so as to satisfy the relationship ($X_{Fe}>X_o$) where $X_{Fe}$ is the Fe content (by % by mass) and $X_o$ is the O content (by % by mass).

The reason that the O content in the titanium material that constitutes the titanium plate of the present embodiment is adjusted to more than 0.005% and less than 0.20% by mass is that, if the O content is 0.20% or more, the resulting titanium plates will have a low Erichsen value, which means their workability will be reduced, even if the Fe content is adjusted to be in the above-mentioned range and to satisfy the relationship ($X_{Fe}>X_o$) in the titanium material.

In this regard, the O content is preferably limited to 0.10% or less.

In addition, the reason that the Fe content ($X_{Fe}$) and the O content ($X_o$) in the titanium material are adjusted so as to satisfy the relationship ($X_{Fe}>X_o$) is that, if the O content is equal to or greater than the Fe content ($X_{Fe}\leq X_o$), the resulting titanium plates will have a low Erichsen value, which means their workability will be reduced, even if the Fe content is in the above-mentioned range and the O content is in the above-mentioned range in the titanium material.

Furthermore, the contents of carbon (C), nitrogen (N) and hydrogen (H) are required to be adjusted to the amounts equivalent to or smaller than those of JIS Type 2 in order to secure good workability in a forming process.

More specifically, the contents of C, N and H are required to be limited to less than 0.015% by mass, respectively.

More preferably, the C content is limited to 0.01% or less, the N content to 0.01% or less and the H content to 0.01% or less.

In terms of the workability of a titanium plate, no lower limit is to be set to the above-mentioned contents of C, N and H. However, an attempt to reduce these contents to an extremely low level could result in a significant increase in the manufacturing cost of titanium plates.

From the view point of avoiding a cost increase, it is preferable that the C content be adjusted to 0.0005% or more, the N content to 0.0005% or more and the H content to 0.0005% or more.

It has been considered that for titanium plates, which are required to have good workability in forming, a greater grain size is better in general. However, in the case of titanium plates that are made of a titanium material having the above-mentioned composition, formability can be enhanced with a smaller grain size. It is to be noted that this fact has been discovered by the present inventors.

More specifically, it is possible to improve the indices indicating workability such as the Erichsen value by making a titanium plate so that the circle-equivalent mean diameter of α phase grains is 10 μm or less.

On the other hand, if the circle-equivalent mean diameter of α phase grains exceeds 10 μm, workability could deteriorate with the Erichsen value lowered to, for example, less than 10 mm.

The "circle-equivalent mean diameter of α phase grains" can be found by carrying out measurement of the crystal grain size number by the cutting method according to JIS G 0551 and then converting the obtained result into grain size.

The circle-equivalent mean diameter of α phase grains (the crystal grain size converted from the grain size number) can be adjusted, mainly by adjustment of the Fe content in the components of a titanium plate.

As to the Fe content, it is known that the crystal grain size number becomes smaller (the crystal grain size becomes larger) with an increase of the Fe content in pure titanium.

For example, it is reported that, in the range of O contents of 0.09 to 0.11% by mass, as the Fe content is varied from 0.04% by mass to 0.27% by mass, the average crystal grain size, which is measured after cold rolling at a reduction of 50% followed by annealing at 800° C. for 10 minutes, varies from approximately 63 μm to approximately 14 μm (by Yutaka Kondo and Shujiro Suzuki in "Sumitomo Metal Industries Journal," Vol. 8, No. 4, page 201, FIG. 42).

In general, when a workpiece made of a titanium material having an Fe content of 0.06% by mass or more is held at a temperature of 595° C. or more, a two-phase structure of an α phase and a β phase is formed.

If the Fe content is less than 0.06% by mass, a single α phase mostly results although a β phase slightly crystallizes somewhere in a temperature range between 500° C. and 800° C.

In conventional titanium products intended for applications requiring high formability, their Fe content may be less than 0.06% by mass, or even when the Fe content is increased by reducing the O content to a very low level of 0.01 to 0.03% by mass, the Fe content still may be 0.1% by mass or less. As such, conventional titanium products mostly have a single α phase structure during annealing.

Consequently, in conventional titanium products, the growth rate of crystals (α grains) is high, so that the crystal grain size rapidly becomes large (the grain size number becomes small) with time during annealing.

In contrast, the titanium plate of the present embodiment has a two-phase structure of an α phase and a β phase during annealing because of the above-mentioned Fe and O contents.

The two-phase structure allows β grains to suppress the growth of α grains, and thus prevents the grain size from rapidly becoming large (the grain size number from becoming small).

In addition, the crystal grain size is adjustable, not only by adjustment of Fe content as described above, but also by adjustment of the finish cold rolling reduction ratio, the finish annealing temperature, the finish annealing time and the like in the production of titanium plates.

These conditions in a method of producing titanium plates are discussed below.

Reference is now made to the following conditions in the production of titanium plates: the finish cold rolling reduction ratio, the finish annealing temperature and the finish annealing time. As to the finish cold rolling reduction ratio, it may be increased in order to facilitate recrystalliztion.

Further, the finish annealing temperature may be raised to allow crystal grains to grow so as to increase the crystal grain size.

Furthermore, the finish annealing time may be extended to allow crystal grains to grow so as to increase the crystal grain size.

Based on these tendencies, titanium plates may be produced by adjusting the finish cold rolling reduction ratio, the finish annealing temperature and the finish annealing time so that the "G" value in the following formula (1) is 14 or less. This makes it possible to more reliably limit the circle-equivalent mean diameter of α phase grains of an obtained titanium plate to 10 μm or less.

$$G=11.5\times X_{Fe}^{-0.72}\times\{-1n(1-r/100)\}^{-0.85}\times\exp\{(-1500)/(273+T)\}\times t^{0.058} \quad (1)$$

where $X_{Fe}$ represents the Fe content (%), r represents the finish cold rolling reduction ratio (%), T represents the annealing temperature (° C.) and t represents the finish annealing time (min).

The "G" value in the above formula (1) is preferably 10 or less.

In addition, the "G" value is preferably 2 or more in terms of ease in producing titanium plates.

Even when the "G" value falls within the above range, it is necessary to adjust the finish cold rolling reduction ratio to 20% or more, the finish annealing temperature to 600° C. to 880° C. and the finish annealing time to 0.5 to 60 minutes, in order to more reliably limit a circle-equivalent mean diameter of α phase grains to 10 μm or less.

The reason that the finish cold rolling reduction ratio is adjusted to the above range is that recrystallization does not occur if the finish cold rolling reduction ratio is less than 20%.

Further, the reason that the finish annealing temperature is adjusted to the above range is that recrystallization does not occur if the finish annealing temperature is less than 600° C., and β transformation occurs if the finish annealing temperature exceeds 880° C.

Furthermore, the reason that the finish annealing time is adjusted to the above range is that recrystallization may not occur if the finish annealing time is less than 0.5 minutes, and if it exceeds 60 minutes, precipiration of TiFe could increase to thereby cause deterioration in the workability of a titanium plate.

By employing the above-mentioned components and manufacturing conditions, it is possible to produce a titanium plate having high strength and good workability.

Although details are not provided here, matters known from conventional titanium plates and production methods thereof may be adopted to be applied to the titanium plate and the production method thereof of the present embodiment to such an extent as not to materially impair the advantageous effects of the present invention.

EXAMPLES

Now, the present invention is described in more detail by way of examples, which should not be construed as limiting the invention.

Examples 1 to 7, Conventional Examples 1 to 3, Comparative Examples 1 to 7

Preparation of Test Piece

Slabs having compositions shown in Table 1 were prepared by way of button arc melting. The slabs were hot rolled at 850° C. and annealed at 750° C. Thereafter, the slabs were subjected to descaling of the surface, which was followed by cold rolling to prepare plate-shaped samples with a thickness of 0.5 mm.

The Fe contents shown in Table 1 were measured in accordance with JIS H 1614, and the O contents were measured in accordance with JIS H 1620.

The plate-shape samples were annealed at 800° C. for 15 minutes to be used as evaluation samples.

As Conventional Examples 1 to 3, products that are commercially available as JIS 1 to 3 types having typical compositions were used.

(Evaluation)

(Tensile Strength)

Measurement of tensile strength was carried out in accordance with JIS Z 2241 for the evaluation samples prepared as described above. The results are shown in Table 1.

(Erichsen Value)

Measurement of the Erichsen value was carried out in accordance with JIS Z 2247 for the evaluation samples prepared as described above. The results are shown in Table 1 and FIG. 1.

(Circle-Equivalent Mean Diameter of α Phase Grains)

To determine the crystal grain size numbers, measurement of the grain size number was carried out by the cutting method in accordance with JIS G 0551, and based on the obtained grain size numbers, circle-equivalent mean diameters of α phase grains ("grain size" in Table 1) were found by calculation. The results are shown in Table 1.

(Polishability)

The evaluation samples prepared as described above were polished with waterproof abrasive paper up to #500, and then polished by buffing (diamond spray: 9 μm, rotation speed: 150 rpm, load: 150N) for two minutes. Thereafter, surface roughnesses Ra (JIS B 0601: arithmetical mean roughness) of the original evaluation samples and the polished evaluation samples were measured, respectively, to determine the variations.

The following formula was used to evaluate polishability, where Ra 1 represents the surface roughness of the original evaluation sample and Ra2 represents the surface roughness of the polished evaluation sample.

Polishability=(Ra2/Ra1)

The results are shown in Table 1.

TABLE 1

| | r (%) | T (° C.) | t (min) | $X_{Fe}$ (mass %) | $X_o$ (mass %) | $X_{Fe}/X_o$ | G value | $X_H$ (mass %) | $X_N$ (mass %) | $X_C$ (mass %) | Grain size (μm) | Tensile strength (MPa) | Erichsen value (mm) | Polish-ability |
|---|---|---|---|---|---|---|---|---|---|---|---|---|---|---|
| Conventional Example 1 (*1) | 83 | 800 | 15 | 0.031 | 0.051 | 0.61 | 33.19 | 0.0030 | 0.005 | 0.003 | 88.4 | 452 | 11.7 | 0.81 |
| Comparative Example 1 | 83 | 800 | 15 | 0.061 | 0.051 | 1.20 | 20.39 | 0.0026 | 0.007 | 0.003 | 26.3 | 461 | 12.5 | 0.77 |
| Example 1 | 83 | 800 | 15 | 0.110 | 0.049 | 2.24 | 13.34 | 0.0032 | 0.006 | 0.004 | 10.0 | 472 | 12.7 | 0.71 |
| Example 2 | 83 | 800 | 15 | 0.305 | 0.061 | 5.00 | 6.40 | 0.0036 | 0.007 | 0.004 | 7.8 | 545 | 12.5 | 0.60 |
| Conventional Example 2 (*2) | 83 | 800 | 15 | 0.100 | 0.132 | 0.76 | 14.28 | 0.0028 | 0.008 | 0.003 | 52.6 | 553 | 7.5 | 0.73 |
| Example 3 | 83 | 800 | 15 | 0.189 | 0.102 | 1.85 | 9.03 | 0.0034 | 0.005 | 0.003 | 9.0 | 560 | 10.5 | 0.62 |
| Example 4 | 83 | 800 | 15 | 0.479 | 0.100 | 4.79 | 4.62 | 0.0025 | 0.005 | 0.005 | 7.8 | 634 | 11.5 | 0.51 |
| Comparative Example 2 | 83 | 800 | 15 | 0.812 | 0.112 | 7.25 | 3.16 | 0.0024 | 0.007 | 0.005 | 7.8 | 748 | 7.0 | 0.50 |
| Conventional Example 3 (*3) | 83 | 800 | 15 | 0.117 | 0.193 | 0.61 | 12.76 | 0.0035 | 0.007 | 0.005 | 21.2 | 618 | 6.9 | 0.70 |
| Comparative Example 3 | 83 | 800 | 15 | 0.107 | 0.177 | 0.60 | 13.60 | 0.0033 | 0.005 | 0.005 | 9.3 | 599 | 6.6 | 0.68 |
| Comparative Example 4 | 83 | 800 | 15 | 0.168 | 0.177 | 0.95 | 9.83 | 0.0029 | 0.007 | 0.005 | 7.0 | 617 | 7.0 | 0.65 |
| Example 5 | 83 | 800 | 15 | 0.218 | 0.193 | 1.13 | 8.15 | 0.0023 | 0.006 | 0.005 | 7.0 | 648 | 7.9 | 0.55 |
| Example 6 | 83 | 800 | 15 | 0.344 | 0.178 | 1.93 | 5.87 | 0.0031 | 0.007 | 0.003 | 5.7 | 672 | 9.0 | 0.50 |
| Example 7 | 83 | 800 | 15 | 0.354 | 0.169 | 2.09 | 5.75 | 0.0037 | 0.008 | 0.003 | 5.3 | 666 | 8.6 | 0.51 |
| Comparative Example 5 | 83 | 800 | 15 | 0.611 | 0.188 | 3.25 | 3.88 | 0.0027 | 0.007 | 0.003 | 4.8 | 762 | 6.3 | 0.45 |
| Comparative Example 6 | 83 | 800 | 15 | 0.189 | 0.102 | 1.85 | 9.03 | 0.0204 | 0.005 | 0.003 | 9.0 | 570 | 7.2 | 0.62 |
| Comparative Example 7 | 83 | 800 | 15 | 0.209 | 0.102 | 2.05 | 8.90 | 0.0124 | 0.017 | 0.020 | 9.0 | 587 | 5.5 | 0.57 |

* r: cold rolling reduction ratio, T: finish annealing temperature, t: finish annealing time, $X_{Fe}$: Fe content, $X_o$: O content, $X_H$: H content, $X_N$: N content, $X_C$: C content G value = $11.5 \times X_{Fe}^{-0.72} \times \{-\ln(1 - r/100)\}^{-0.35} \times \exp\{(-1500)/(273 + T)\} \times t^{0.058}$

*1 Commercially available product as JIS Type 1

*2 Commercially available product as JIS Type 2

*3 Commercially available product as JIS Type 3

With reference to the table, comparisons are made, for example, between Conventional Example 1, Comparative Example 1 and Example 1; between Conventional Example 3 and Example 5; and between Comparative Examples 3, 4 and Example 6, these compared examples being approximately equal in O content but different in Fe content. Then, it is found that by increasing Fe content in a titanium material while at the same time adjusting O content in the titanium material to a predetermined value, it is possible to enhance strength in the resulting titanium plates while preventing their Erichsen values from being lowered.

In FIG. 1, Conventional Example 1, Comparative Example 1 and Examples 1 and 2 of JIS Type 1 oxygen level, Conventional Example 2, Examples 3, 4 and Comparative Example 2 of JIS Type 2 oxygen level, and Conventional Example 3, Comparative Examples 3 to 5 and Examples 5 to 7 of JIS Type 3 oxygen level are represented by the identical symbols, respectively, based on the O content. It is found that, in any of these categories, a significant change in the Erichsen value is observed after the Fe/O ratio indicated by the horizontal axis reaches 1.

In other words, it is found that a good Erichsen value can be obtained by satisfying the condition, $X_{Fe} > X_o$.

In addition, from FIG. 1, it is found that good results cannot be obtained when Fe is contained in the amount exceeding 0.6% even if the Fe/O ratio exceeds 1.

This indicates that the present invention can provide titanium plates that have both high strength and good workability.

Furthermore, Comparative Examples 6 and 7, which are approximately equal to Example 3 in the contents of Fe and O but are different in the contents of H, N and C, exhibit a decrease in workability as indicated by the lowered Erichsen values.

(Comparison Based on Manufacturing Conditions: Variation in Workability Depending on the Circle-Equivalent Mean Diameter of α Phase Grains)

Then, experiments were made to examine variations in the workability of titanium plates caused by differences in manufacturing conditions.

Examples 8 to 26, Comparative Examples 8 to 13

Preparation of Test Piece

An ingot was prepared by use of a small sized vacuum arc melting and the ingot was forged at 1150° C. into slabs with a thickness of 50 mm.

The slabs were hot rolled at 850° C., then annealed at 750° C., and thereafter subjected to descaling of the surfaces.

The surfaces of the descaled test slabs were machined so as to have several kinds of plate thickness ranging from 0.6 to 5.0 mm. Then, cold rolling was performed to prepare plate-shape samples (titanium plates) with a thickness of 0.5 mm.

The titanium plates were finish annealed at temperatures of 600 to 850° C. for 1 to 60 minutes in a vacuum atmosphere so as to adjust the crystal grain size.

The Fe contents in the descaled samples were measured in accordance with JIS H 1614, and the O contents in accordance with JIS H 1620.

The Erichsen values of the titanium plates, the crystal grain sizes of which were adjusted as described above, were measured in accordance with JIS Z 2247 and measurement of the crystal grain size number was carried out by the cutting method in accordance with JIS G 0551. Based on the obtained grain size numbers, circle-equivalent mean diameters of α phase grains ("grain size" in Table 2) were determined.

The results are shown in Table 2.

TABLE 2

| | $X_{Fe}$ (mass %) | $X_o$ (mass %) | r (%) | T (° C.) | t (min) | $X_{Fe}/X_o$ | G value | Erichsen value (mm) | Grain size (μm) |
|---|---|---|---|---|---|---|---|---|---|
| Example 8 | 0.121 | 0.035 | 90 | 600 | 1 | 3.46 | 7.05 | 12.6 | 4.60 |
| Example 9 | 0.121 | 0.035 | 90 | 650 | 1 | 3.46 | 7.74 | 12.4 | 6.60 |
| Example 10 | 0.121 | 0.035 | 80 | 650 | 1 | 3.46 | 8.77 | 11.9 | 9.00 |
| Example 11 | 0.121 | 0.035 | 80 | 700 | 10 | 3.46 | 10.90 | 11.5 | 10.00 |
| Comparative Example 8 | 0.121 | 0.035 | 37.5 | 700 | 10 | 3.46 | 16.76 | 10.5 | 14.10 |
| Comparative Example 9 | 0.121 | 0.035 | 37.5 | 850 | 60 | 3.46 | 22.85 | 9.8 | 20.60 |
| Example 12 | 0.217 | 0.053 | 90 | 600 | 1 | 4.09 | 4.63 | 12.1 | 3.60 |
| Example 13 | 0.217 | 0.053 | 90 | 650 | 1 | 4.09 | 5.08 | 12.0 | 4.20 |
| Example 14 | 0.217 | 0.053 | 80 | 650 | 1 | 4.09 | 5.76 | 12.2 | 5.70 |
| Example 15 | 0.217 | 0.053 | 80 | 850 | 1 | 4.09 | 7.69 | 11.8 | 7.80 |
| Example 16 | 0.217 | 0.053 | 37.5 | 650 | 1 | 4.09 | 8.86 | 11.4 | 8.10 |
| Example 17 | 0.217 | 0.053 | 37.5 | 650 | 10 | 4.09 | 10.13 | 10.6 | 9.30 |
| Comparative Example 10 | 0.217 | 0.053 | 37.5 | 850 | 60 | 4.09 | 15.01 | 10.0 | 14.10 |
| Comparative Example 11 | 0.217 | 0.053 | 16.7 | 850 | 60 | 4.09 | 20.89 | 8.7 | 22.10 |
| Example 18 | 0.355 | 0.095 | 90 | 650 | 1 | 3.74 | 3.56 | 11.6 | 3.40 |
| Example 19 | 0.355 | 0.095 | 80 | 700 | 10 | 3.74 | 5.02 | 11.4 | 5.20 |
| Example 20 | 0.355 | 0.095 | 37.5 | 700 | 10 | 3.74 | 7.72 | 11.1 | 7.50 |
| Example 21 | 0.355 | 0.095 | 37.5 | 850 | 10 | 3.74 | 9.49 | 10.8 | 9.60 |
| Example 22 | 0.355 | 0.095 | 37.5 | 850 | 60 | 3.74 | 10.53 | 10.5 | 10.00 |
| Comparative Example 12 | 0.355 | 0.095 | 16.7 | 850 | 60 | 3.74 | 14.65 | 9.5 | 14.60 |
| Example 23 | 0.482 | 0.042 | 90 | 650 | 1 | 11.48 | 2.86 | 12.0 | 3.00 |
| Example 24 | 0.482 | 0.042 | 80 | 700 | 10 | 11.48 | 4.03 | 11.8 | 4.60 |
| Example 25 | 0.482 | 0.042 | 37.5 | 700 | 10 | 11.48 | 6.20 | 11.2 | 7.50 |
| Example 26 | 0.482 | 0.042 | 37.5 | 850 | 60 | 11.48 | 8.45 | 10.6 | 9.30 |
| Comparative Example 13 | 0.482 | 0.042 | 16.7 | 850 | 60 | 11.48 | 11.76 | 9.9 | 13.10 |

* r: cold rolling reduction ratio, T: finish annealing temperature, t: finish annealing time, $X_{Fe}$: Fe content, $X_o$: O content, $X_H$: H content, $X_N$: N content, $X_C$: C content G value = $11.5 \times X_{Fe}^{-0.72} \times \{-1n(1-r/100)\}^{-0.35} \times \exp\{(-1500)/(273+T)\} \times t^{0.058}$ As is seen from Table 2, Examples 8 to 11 and Comparative Examples 8, 9 are equal in Fe and O contents, but the circle-equivalent mean diameters of α phase grains are adjusted based on the differences in the cold rolling reduction ratios and the annealing conditions. It is found that the smaller the circle-equivalent mean diameter of α phase grains is, the greater the Erichsen value is.

The same tendency is seen from the data of any of the other groups that each have the same Fe and O contents, ie., the data of the group of Examples 12-17 and Comparative Examples 10 and 11; the data of the group of Examples 18-22 and Comparative Example 12; and the data of the group of Examples 23-26 and Comparative Example 13.

In conclusion, from Table 2, it is appreciated that titanium plates, when produced under such manufacturing conditions that the value G becomes small so as to have a small circle-equivalent mean diameter of α phase grains, have a high Erichsen value and thus have good workability.

What is claimed is:

1. A titanium plate made of a titanium material in a plate shape, the titanium material consisting of by mass: more than 0.10% and less than 0.60% iron; more than 0.005% and less than 0.20% oxygen; less than 0.015% carbon; less than 0.015% nitrogen; less than 0.015% hydrogen; and balance titanium and unavoidable impurities, provided that the iron content is greater than the oxygen content, wherein the titanium plate has a two-phase structure of an α phase and a β phase, and wherein the circle-equivalent mean diameter of a phase grains is 10 μm or less.

2. A method of producing a titanium plate, which has a two-phase structure of an α phase and a β phase, using a titanium material that consists of by mass: more than 0.10% and less than 0.60% iron; more than 0.005% and less than 0.20% oxygen; less than 0.015% carbon; less than 0.015% nitrogen; less than 0.015% hydrogen; and balance titanium and unavoidable impurities, provided that the iron content is greater than the oxygen content, the method comprising, annealing the titanium material, after hot rolling of the titanium material, processing the titanium material under the conditions of: a finish cold rolling reduction ratio of 20% or more; a finish annealing temperature of 600 to 880° C.; a finish annealing time of 0.5 to 60 minutes; and the value of G in the following formula (1) being 14 or less:

$$G=11.5\times X_{Fe}^{-0.72}\times\{-1n(1-r/100)\}^{-0.35}\times\exp\{(-1500)/(273+T)\}\times t^{0.058} \quad (1)$$

where $X_{Fe}$ represents the Fe content (%), r represents the finish cold rolling reduction ratio (%), T represents the finish annealing temperature (° C.) and t represents the finish annealing time (min).

3. The method of claim 2, wherein the annealing temperature is about 750° C.

* * * * *